US005087872A

United States Patent [19]

Gupta

[11] Patent Number: 5,087,872

[45] Date of Patent: Feb. 11, 1992

[54] CIRCULATING LOAD APPARATUS

[75] Inventor: Suresh C. Gupta, Los Alamitos, Calif.

[73] Assignee: Deltec Electronics Corporation, San Diego, Calif.

[21] Appl. No.: 479,467

[22] Filed: Feb. 13, 1990

[51] Int. Cl.[5] ..... G05F 5/00

[52] U.S. Cl. ..... 323/340; 323/255; 323/344; 363/71; 307/51; 307/56; 307/82

[58] Field of Search ..... 323/247, 255, 259, 260, 323/340, 344, 355, 358, 359, 361; 363/71, 72; 307/51-56, 58, 63, 77, 82, 83

[56] References Cited

U.S. PATENT DOCUMENTS 4,429,269 1/1984 Brown ..... 323/344 X

*Primary Examiner*—Steven L. Stephan
*Assistant Examiner*—Emanuel Todd Voeltz
*Attorney, Agent, or Firm*—Foley & Lardner

[57] ABSTRACT

A circulating load apparatus for loading a power supply. The power supply has a power input terminal, a power output terminal and a power return terminal. The power supply provides an output voltage at the power output terminal with respect to the power return terminal. The output voltage of the power supply is controlled to be substantially identical in amplitude to the network voltage of a network source, provided at a network source terminal with respect to a source return terminal. The power supply, power return terminal is coupled to the network source, source return terminal. The power supply power input terminal is coupled to the network source terminal to be powered by voltage and current from the network source terminal. The circulating load apparatus has a voltage source for supplying a voltage between a first and second terminal. The voltage source is connected in series between the network source terminal and the power supply power output terminal. The output voltage of the power supply and the voltage source add to provide output power to the network source. An adjusting circuit adjusts the voltage of the voltage source to position the output current of the power supply within a predetermined range to deliver power from the power supply to the network source.

22 Claims, 9 Drawing Sheets

CIRCULATING LOAD APPARATUS

BACKGROUND OF THE INVENTION

1. Field of the Invention

This invention relates to the field of test equipment and methods for loading the output voltage of a power supply. This invention is particularly related to burn-in test equipment that is used to load the output of a power supply having a sinusoidal output voltage and output frequency that is substantially equivalent in amplitude and output frequency to the voltage and frequency of the electrical service providing electrical power to the power supply. This invention is more particularly related to the field of test equipment used to load un-interruptable power supplies (UPS) that provide temporary sinusoidal voltage service at relatively high output power levels such as the UPS power supplies that provide back-up power for computer facilities.

2. Description of Prior Art

After an ac power supply is manufactured, it is typically operated in a burn-in test circuit at or near its rated capacity for a period of time calculated to provide an increased level of confidence in the reliability of the unit to be delivered.

Resistors are conventionally used to load the output of an ac power supply such as a UPS power supply during burn-in test. The power dissipated by the resistive load is typically dissipated by convection or conductive cooling. The energy that is dissipated is typically wasted along with the losses in the power supply attributable to the conversion and control process necessary to provide the required output power. The energy that is dissipated in the test must be purchased by the manufacturer, who adds the cost of the energy that is used to the cost of the power supply product.

SUMMARY OF INVENTION

It is an object of this invention to provide an apparatus and circuit for loading a sinusoidal output voltage of a UPS power supply during its test.

It is a further objective of the invention to return a major portion of the energy provided to the power input terminals of the power supply, back to the electrical service delivering sinusoidal voltage to the input terminals of the power supply.

It is another object of the invention to eliminate or reduce the need for cooling equipment and energy to operating the cooling equipment necessary with dissipative loads.

These objects are realized in the invention circulating load apparatus for loading a power supply having a power input terminal, a power output terminal and a power return terminal. The power supply provides an output voltage at the power output terminal with respect to the power return terminal.

The output voltage of the power supply is controlled to be substantially identical in amplitude to the network voltage of a network source, provided at a network source terminal with respect to a source return terminal. The network source is a source such as the power service for a metropolitan area. The power return terminal is coupled to the source return terminal. The power supply power input terminal is coupled to the network source terminal to be powered by voltage and current from the network source terminal.

The circulating load apparatus has a voltage source for supplying a voltage between a first and second terminal. The voltage source is connected in series between the network source terminal and the power supply power output terminal. The output voltage of the power supply and the voltage source add to provide output power to the network source. An adjusting means adjusts the amplitude of the voltage of the voltage source to position the output current of the power supply within a predetermined range.

DESCRIPTION OF THE PREFERRED EMBODIMENT

Figure 1:
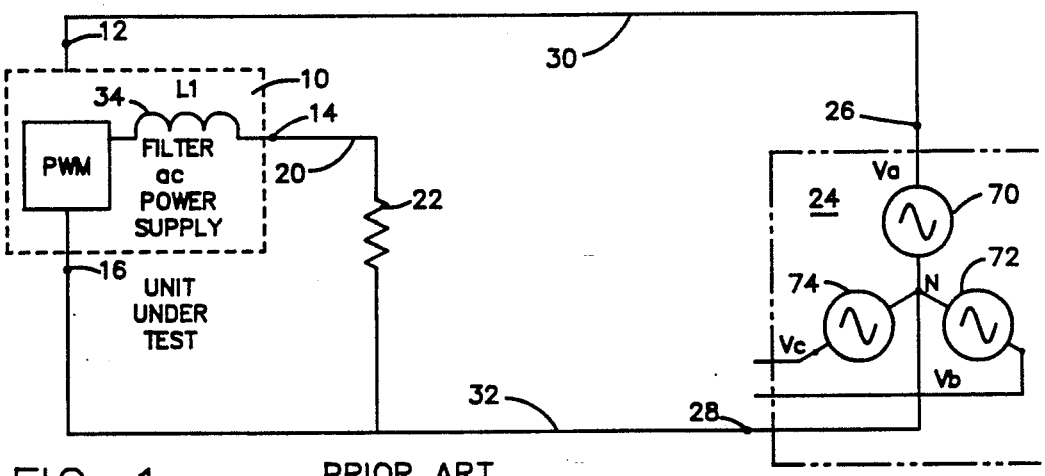
FIG. 1 PRIOR ART
FIG. 1 is a schematic showing a single phase inverter in a UPS power supply. The power supply input terminals are powered from a single phase source, with the power supply sinusoidal output voltage driving a dissipative load.

FIG. 1 shows an ac power supply 10 having a power input terminal 12, a power output terminal 14 and a power return terminal 16 in a conventional prior art burn-in test circuit. The ac power supply 10 provides a single phase, fixed frequency output voltage on output line 20 to a resistive load 22. The single phase, fixed frequency sinusoidal voltage provided on output line 20 is supplied with reference to the power return terminal 16.

Voltage is supplied to the ac power supply 10 from the A phase of a network source 24 at voltage Va from network source terminal 26 with respect to a source return terminal 28. The network source 24 is coupled to ac power supply 10 via power line 30 between power input terminal 12 and network source terminal 26. Power return terminal 16 is connected to source return terminal 28 by a return line 32. The network source 24 is a typical electrical service that qualifies as an infinitely strong network source, such as the network for a large metropolitan city. Power delivered to the resistive load 22 is dissipated by convection or conduction cooling.

A typical three-phase ac power supply is formed by three ac power supply units, such as ac power supply 10. Each of the ac power supplies are phase shifted by 120 degrees from the other two phases. Three loads that correspond to resistive load 22 are connected to the respective output terminals of a three-phase unit during a burn in test. Each resistive load, such as resistive load 22, used in a three phase output load circuit would have a terminal common with the source return terminal 28.

Some conventional UPS power supplies are manufactured with rated output power levels in excess of several hundred kilo-watts. A conventional UPS power supply for modern computer facility might typically have an output power rating of 50 Kilo-watts. A manufacturer might typically have several recently manufactured units operating in burn-in circuits at rated output power at a single time with the attendant cost of providing the electrical power to the input of the power supplies under test as well as the cost associated with cooling the resistive loads 22 in which the output power is dissipated.

This invention reduces the cost of the electrical power necessary for operating an ac power supply units at rated load in a burn-in test circuit by eliminating the resistive load 22, the power dissipated therein, the cooling equipment and the cost of power necessary to operate cooling equipment to cool the resistive loads, such as resistive load 22.

The invention circulating load apparatus and method replaces the function of the resistive load 22 by coupling the power delivered from the power output terminal 14 back into the network source terminal 26. Power that is returned to the network source terminal 26 by the ac power supply 10 reduces the amount of power to be extracted from the network source terminal 26 by the amount of power that is returned. Since no power is dissipated in resistive load 22, no cooling equipment is required.

Figure 2:
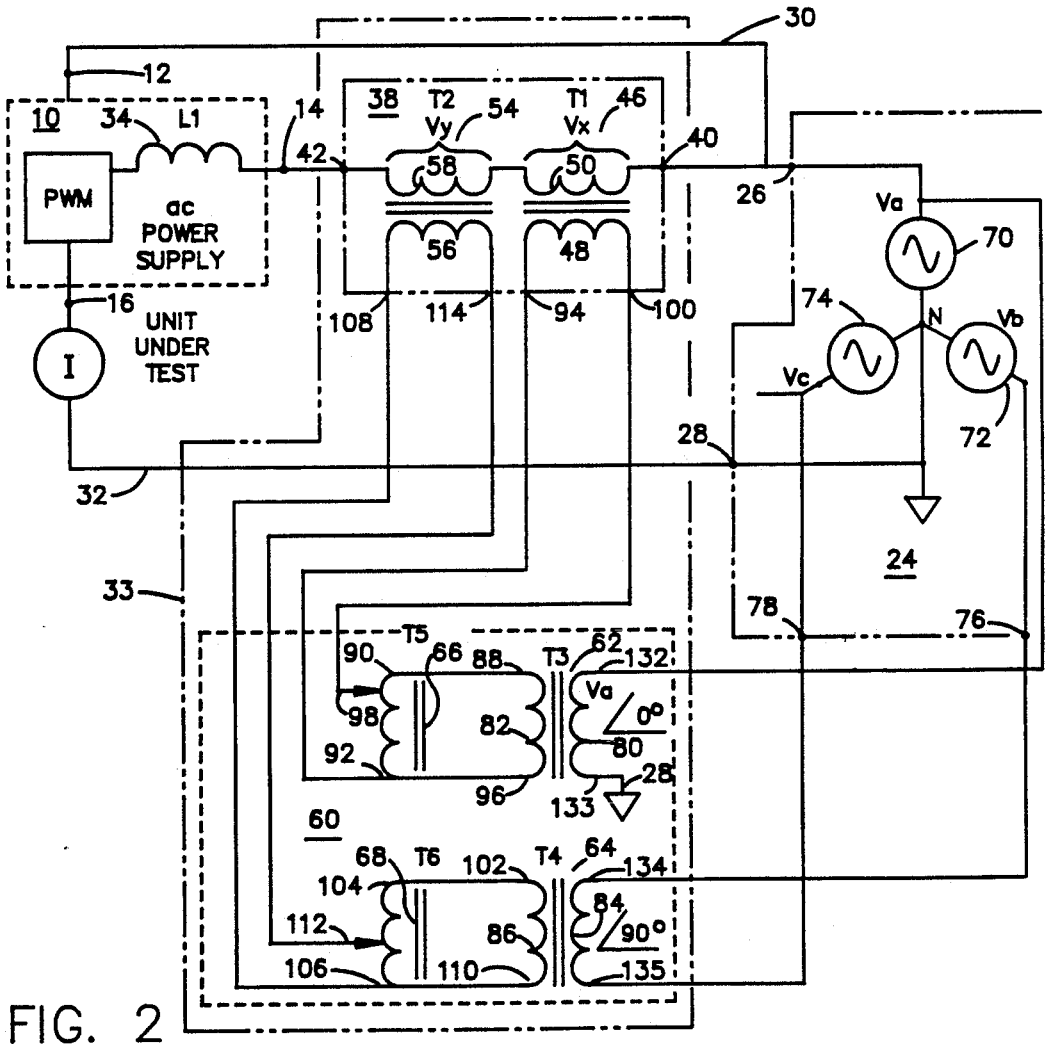
FIG. 2 is a schematic showing a single phase inverter in a UPS power supply. The power supply input terminals are powered from a single phase source. The power supply sinusoidal output voltage drives the invention circulating load apparatus to couple energy back into the single phase source.

FIG. 2 shows a first embodiment of the invention circulating load apparatus within phantom block 33. The circuit within phantom block 33 is inserted into the circuit of FIG. 1 in place of the resistive load 22. The power input terminal 12, power output terminal 14 and the power return terminal 16 are shown as in FIG. 1. The power supply 10 has an internal impedance, such as the impedance provided by L1, 34 that limits output current from the power supply.

The ac power supply 10 provides an output voltage of approximately 120 Vac at the power output terminal 14 with respect to the power return terminal 16. The output voltage of the ac power supply 10 at power output terminal 14 is controlled to be substantially identical in amplitude to the network voltage of network source, Va at network source terminal 26 and on power line 30 with respect to the source return terminal 28. The power return terminal 16 is coupled to the source return terminal 28.

The circuit within phantom block 38 represents a voltage source for supplying a voltage between a source output terminal 40 and a source input terminal 42. The voltage source 38 is connected in series between the network source terminal 26 and the power output terminal 14. The output voltage of the ac power supply 10 at power output terminal 14 with respect to the power return terminal 16 and the output voltage of the source output terminal 40 with respect to the source input terminal 42 add to provide output power to the network source terminal 26.

In the first embodiment of FIG. 2, the voltage source 38 comprises a reference isolation transformer T1, 46 and a quadrature isolation transformer T2, 54. The reference isolation transformer, T1, 46 has a primary winding 48 and a secondary winding 50. The quadrature isolation transformer T2, 54 has a primary winding 56 and a secondary winding 58. The reference isolation transformer secondary windings 50, and the quadrature isolation transformer secondary winding 58 are connected in series with each other between the source output terminal 40 and the source input terminal 42 of voltage source 38. The series connected secondary windings 50, 58 connect the power output terminal 14 of the ac power supply 10 to the network source terminal 26. A resistive load, such as resistive load 22 in FIG. 1, is not used.

The circuit within phantom block 60, in FIG. 2, represents a first embodiment of an adjusting means for adjusting the voltage of the voltage source 38 to position the output current of the ac power supply 10 within a predetermined range. In this first embodiment, the adjusting means 60 comprises a network source reference isolation transformer T3, 62 and a network source quadrature isolation transformer T4, 64, a first adjustable transformer T5, 66 and a second adjustable transformer T6, 68.

The network source 24 provides power to the adjusting means 60 from a first, second and third voltage source 70, 72, 74 respectively. The first, second and third voltage sources 70, 72, 74 provide a first source voltage Va, a second source voltage Vb and a third source voltage Vc respectively at network source terminals 26, 76, 78. Each source voltage is provided with respect to the source return terminal 28. The second source voltage Vb trails the first source voltage by substantially 120 degrees. The third source voltage Vc trails the second source voltage Vb by substantially 120 degrees.

The network source reference isolation transformer T3, 62 has a primary winding 80 and a secondary 82. The network source quadrature isolation transformer T4, 64 has a primary winding 84 and a secondary 86. The network source reference isolation transformer primary winding 80 is driven by the first source voltage Va at network source terminal 26 with respect to neutral at the source return terminal 28. The network source quadrature isolation transformer primary winding 84 is driven by the second source voltage, Vb, at terminal 76 with respect to the third source voltage, Vc, at terminal 78.

In the embodiment of FIG. 2, the network source reference isolation transformer secondary 82 has a first end 88 that is connected to drive the first end 90 of the first adjustable transformer T5, 66. The T5 second end terminal 92 is connected to T1 primary second terminal 94 and to the T3 secondary second end 96. The adjustable tap terminal 98 is connected to the reference isolation transformer T1 primary first terminal 100. The first adjustable transformer T5, 66 is manually adjusted to provide the adjustable reference voltage at the adjustable tap terminal 98.

The network source quadrature isolation transformer secondary 86 has a first end 102 that is connected to drive the first end 104 of the second adjustable transformer T6, 68. The T6 second end terminal 106 is connected to the quadrature isolation transformer T2 primary second terminal 108 and to the network source quadrature isolation transformer T4 secondary second end 110. The adjustable tap terminal 112 of the second adjustable transformer T6, 68 is connected to the quadrature isolation transformer T2 primary first terminal 114. The transformer T6 is manually adjusted to provide the adjustable quadrature voltage at the adjustable tap terminal 112.

The adjustable reference voltage is in phase with Va and the adjustable quadrature voltage lags the adjustable reference voltage by 90 degrees and is adjusted to provide an adjusted secondary reference voltage across the reference isolation transformer secondary 50 and an adjusted secondary quadrature voltage across the quadrature isolation transformer secondary 58. The amplitudes of the adjusted secondary reference voltage and the adjusted secondary quadrature voltage are adjusted individually to be sufficient to provide output power from the power output terminal 14 to the network source terminal 26.

Figure 7:
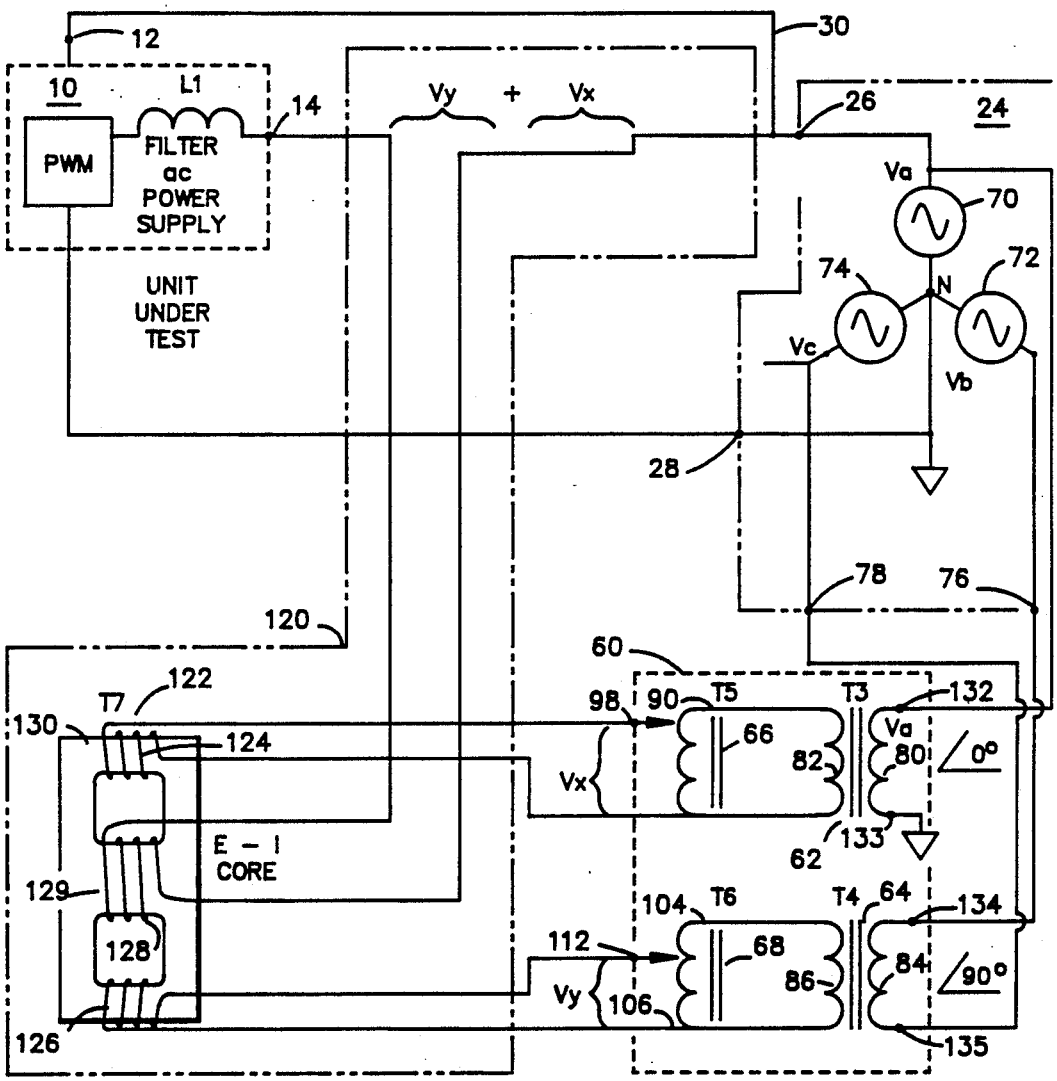
FIG. 7 is a schematic showing an ac power supply. The ac power supply input terminals are powered from a single phase source. The ac power supply sinusoidal output voltage drives a single output E - I transformer circulating load apparatus with isolated adjustable transformers.
Figure 8:
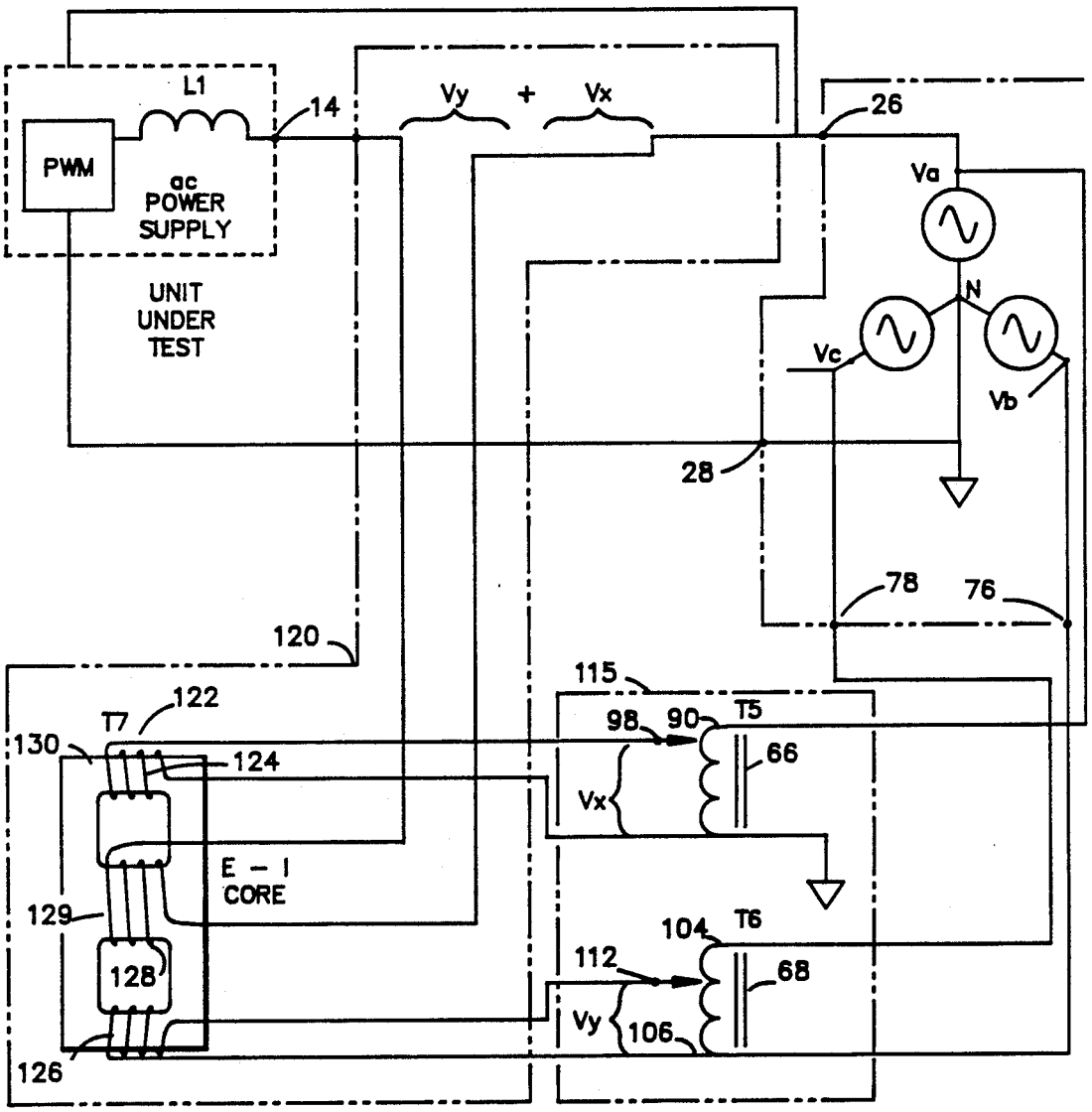
FIG. 8 is a schematic showing a single phase ac power supply. The power supply input terminals are powered from a single phase source. The power supply sinusoidal output voltage drives the output secondary of the recirculating load apparatus E - I transformer, without isolated adjustable transformers.

The circuit within phantom block 115 in FIG. 8 represents an alternative arrangement for an adjusting means for adjusting the amplitude of the voltage of the voltage source to adjust the output current of the ac power supply 10 to be within a predetermined range. The arrangement of phantom block 115 eliminates the use of isolation transformers T3 and T4 as they are used for voltage isolation and matching to the adjustable transformers T5 and T6 respectively in FIG. 2 and FIG. 7. The arrangement of phantom block 115 is an alternative but not a preferred embodiment since network source reference and quadrature transformers T3 and T4 are used to step the reference and quadrature voltage down into a range that increases the resolution of the voltage obtained from the first and second adjustable transformers T5 and T6.

The voltages required by the primaries of the reference and quadrature isolation transformers T1 and T2, 46, 54 in the voltage source 38, in operation, represent a small percentage of the available line voltage. The reference and quadrature isolation transformers T3 and T4 are step down transformers that couple approximately 10 percent of the line voltage to the first and second adjustable transformers T5 and T6, 66, 68, thereby increasing the resolution of the voltage obtained from the respective adjustable transformer. Stepping down the voltage applied to the adjustable transformer permits the circuit to use a smaller adjustable transformer since fewer volt seconds have to be supported by the core and primary winding of the adjustable transformer.

FIG. 7 shows an alternative and preferred embodiment for the voltage source represented by phantom block 38 in FIG. 2. A single transformer T7, 122 is used in the voltage source 120. In the circuit of FIG. 7, the single transformer T7, 122 is an isolation transformer formed using an E-I core that has a first primary winding 124 driven by the adjustable reference voltage from adjustable tap terminal 98, and a second primary 126 that is driven by the adjustable quadrature voltage from adjustable tap terminal 112. The circuit and function of the adjusting means in phantom box 60 in FIG. 7 are identical with the circuit and function of phantom box 60 appearing in FIG. 2.

A secondary winding 128 on the center post 129 of the core 130, in FIG. 7, is connected in series with the ac power supply 10 external to the network source 24 between the network source terminal 26 and the power output terminal 14. The adjustable reference voltage at adjustable tap terminal 98 and the adjustable quadrature voltage at adjustable tap terminal 112 are adjusted to provide the sum of an adjusted secondary reference voltage and an adjusted secondary quadrature voltage across the T7 isolation transformer secondary 128. The first and second adjustable transformers T5 and T6, 66, 68 are adjusted manually in the arrangement of FIG. 7 to set the amplitudes of the adjusted secondary reference voltage and the adjusted secondary quadrature voltage to be sufficient to provide output power from the ac power supply 10 to the network source terminal 26. Alternate arrangements of winding on core 30 are permissable as are alternate core configurations.

Referring to FIGS. 2 and 7, the primary winding 80 of network source reference isolation transformer T3, 62 has a first terminal 132 connected to the voltage Va at the phase A source at network source terminal 26. The second terminal 133 of the primary is connected to the neutral return 28.

The primary winding 84 of the network source quadrature transformer T4, 64 has a first 134 terminal connected to voltage Vb at the phase B source at network source 72. The second terminal 135 of the primary is connected to voltage Vc of the phase C source at network source 74. The voltage at Vb with respect to the voltage at Vc represent a source that lags or trails the voltage source represented by the voltage at Va with respect to the network neutral, at source return terminal 28, by 90 degrees.

The voltage at first end terminal 88 of secondary 82 of transformer T3, 62 with respect to terminal 96 represents an isolated voltage source with a phase angle of zero with respect to the phase angle of the source Va with respect to neutral at the network source return terminal 28. The voltage at terminal 102 of secondary 86 of transformer T4, 64 with respect to terminal 110 represents an isolated voltage source with a leading phase angle of 90 degrees with respect to the phase angle of the source Va with respect to neutral.

Figure 3:
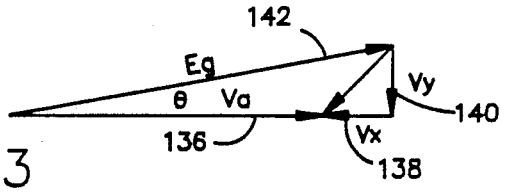
FIG. 3 is a phasor diagram for the circuit of FIG. 2 and the circuits of FIGS. 6–10.

FIG. 3 is a phasor diagram for the circuits of FIG. 2, and FIGS. 6–10. The voltage Eg, represented by phasor 142 is developed by the ac power supply 10, in FIG. 2, at power output terminal 14 with respect to the power return terminal 16. The primary winding 48 of reference isolation transformer T1, 46 is driven by the adjustable reference source of voltage at a phase angle of zero degrees to provide the phasor voltage Vx 138 at the secondary 50. The primary winding 56 of reference quadrature isolation transformer T2, 54 is driven by the adjustable quadrature source of voltage to provide the phasor voltage Vy, 140 that leads phasor voltage Vx by 90 degrees at the secondary 58. Voltages Vx and Vy add in series with each other between the source input terminal 42 and a source output terminal 40 of voltage source 38 and also with the output voltage of the ac power supply 10 at power output terminal 14 to provide a total voltage represented in FIG. 3 by phasor Va, 142.

Figure 4:
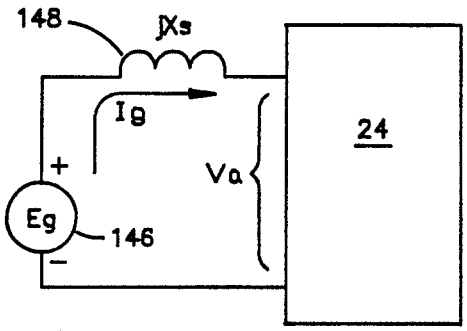
FIG. 4 is a simplified schematic of a single phase generator having a source impedance of JXs driving an infinitely strong network having a voltage Va.
Figure 5:
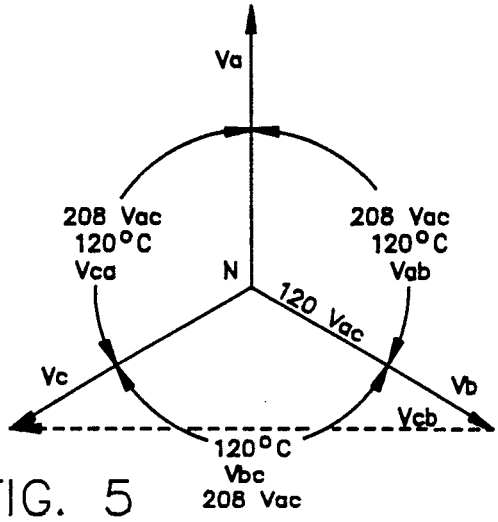
FIG. 5 is a phasor diagram showing the phase relationship and magnitude relationships between the phase branches of an infinitely strong 3 phase network.

Referring to FIG. 4, in the field of synchronous machines, it is known that a generator that approximates an ideal voltage source 146 with a source impedance of JXs, represented by inductor 148 and a voltage Eg, 142 will deliver power to the network source 24, at network source terminal 26 with a voltage Va, measured with respect to source return terminal 28, if Eg is larger than Va, and the phase of Eg leads Va. The power delivered from a generator (voltage source 146) to a motor (network source 24) is obtained from:

$$Pa=[(Va*Eg)/Xs]*\sin d, \text{ for } 0<d<\pi/2 \quad (1)$$

where d is the phase angle between Eg and Va. See, for example, *Electric Machine Theory For Power Engineers*, by Van E. Mablekos, 1980, published by Harper and Row, at page 407, incorporated herein by reference.

The combination of the ac power supply 10 with series inductor 34, operating in series with voltage source 38 in the burn-in test circuit of FIG. 2 is substantially equivalent in function to the generator source Eg 146 in series with the source impedance jXL 148 in FIG. 4. The combination of the ac power supply 10 in series with the voltage source 38 is equivalent to a source with a fixed source impedance jwL1 that provides an amplitude and phase adjustable output voltage to network source 24. The function of the source impedance of the ac power supply 10, i.e. jwL1 is substantially equivalent to that of the Xs term in FIG. 4. The amplitude of the voltage Eg from the ac power supply 10 under test and the phase of Eg are adjusted by adjusting the magnitudes of Vx and Vy from the voltage source 38.

Although the PWM in the ac power supply 10 may be operating at switching frequencies of 10–50 KHz or higher, each incremental volt second envelope of the voltage supplied to L1, 34 is substantially identical, within incremental time spans equivalent to the switching period of the PWM modulator, to the voltage provided to the output of the ac power supply 10 by the infinitely strong network source Va. The inductor L1, 34 is the dominant current limiting reactive component at the line frequency of typically 50–60 Hz.

The adjustable range of the amplitudes of Vx and Vy that are required to deliver substantial amounts to output power to the infinitely strong source are typically only a few percent of the voltage Va. The secondary windings 50, 58 of transformers T1, 46 and T2, 54 must be conservatively rated to pass the maximum output current of the ac power supply 10 under test but the secondary voltage required is low. Since the secondary voltage is relatively low, the output power requirement of the series voltage source 38 is also low leading to the conclusion that the size of the series voltage source 38 and its respective cost is also relatively low.

Figure 6:
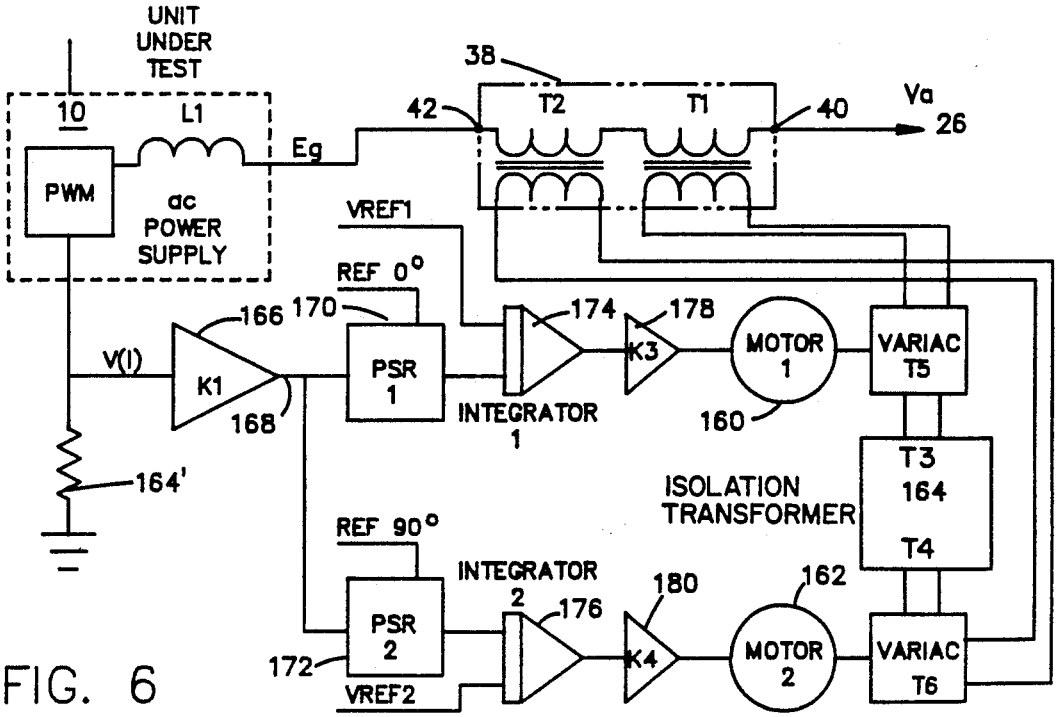
FIG. 6 is the block diagram of a proportion integral controller for the phase controlled voltage source to maintain a constant power output from the ac power supply under test.

FIG. 6 shows a circuit for servo locking the phase and amplitude of source Va to hold the output power level of the ac power supply 10 constant at a predetermined setting. The embodiment shown is used with the circulating load apparatus of FIG. 2 and FIG. 7 modified to provide a servo driven motor for each of the first and second adjustable transformers T5, 66 and T6, 68. The control shaft of the first and second adjustable transformers are driven by the respective first and second motors, 160, 162. Each motor is responsive to a servo motor drive signal for adjusting the output voltage of the respective adjustable transformer.

A current sensing means, such as current sense resistor 164' and scaling amplifier 166 senses the amplitude of current passing through the ac power supply 10 and provide a current amplitude signal proportional to the current amplitude at amplifier output terminal 168.

The servo means for providing the servo motor signals to the respective motors has a first phase sensitive rectifier 170 and second phase sensitive rectifier 172 for detecting in-phase and quadrature phase components of the current amplitude signal at the amplifier output terminal 168. The first phase sensitive rectifier 170 receives an in-phase reference signal, from another network source reference isolation transformer such as T3, (not shown) that operates analog switches within the first phase sensitive rectifier 170 for rectifying and filtering only the in-phase component of the signal from amplifier output terminal 168. The second phase sensitive rectifier 172 receives a quadrature phase reference signal at 90 degrees with respect to the 0 degree reference signal from another network source quadrature isolation transformer such as T4 (not shown). The quadrature reference signal operates analog switches within the second phase sensitive rectifier 172 for rectifying and filtering only the quadrature component of the signal from the amplifier output terminal 168.

The first phase sensitive rectifier 170 provides a reference filtered signal representing the amplitude of the in-phase current passing through the sense resistor 164'. The second phase sensitive rectifier 172 provides a quadrature filtered signal representing the quadrature current signal passing through the sense resistor 164'.

A first and second integrator circuit 174, 176 receive the respective reference and quadrature filtered signals. The first integrator circuit 174 integrates the difference signal between the reference filtered signal and a predetermined dc reference signal VREF1, and outputs a reference error signal to an amplifier 178 to drive the first motor 160. Motor 160 adjusts the adjustable reference voltage to adjust the in-phase component of the power supply current to match the first reference signal. The second integrator 176 integrates the difference signal between the quadrature filtered signal and a predetermined dc quadrature reference signal VREF2, and outputs a quadrature error signal to an amplifier 180 to drive the second motor 162. Motor 162 adjust the quadrature component of the power supply current to match the second reference signal.

Block 164 represents network source reference isolation transformer T3, 62 and the network source quadrature isolation transformer T4, 64 in an arrangement identical to that shown in FIG. 2 and FIG. 7 for providing excitation to the first and second adjustable transformers T5, 66 and T6, 68.

Figure 9:
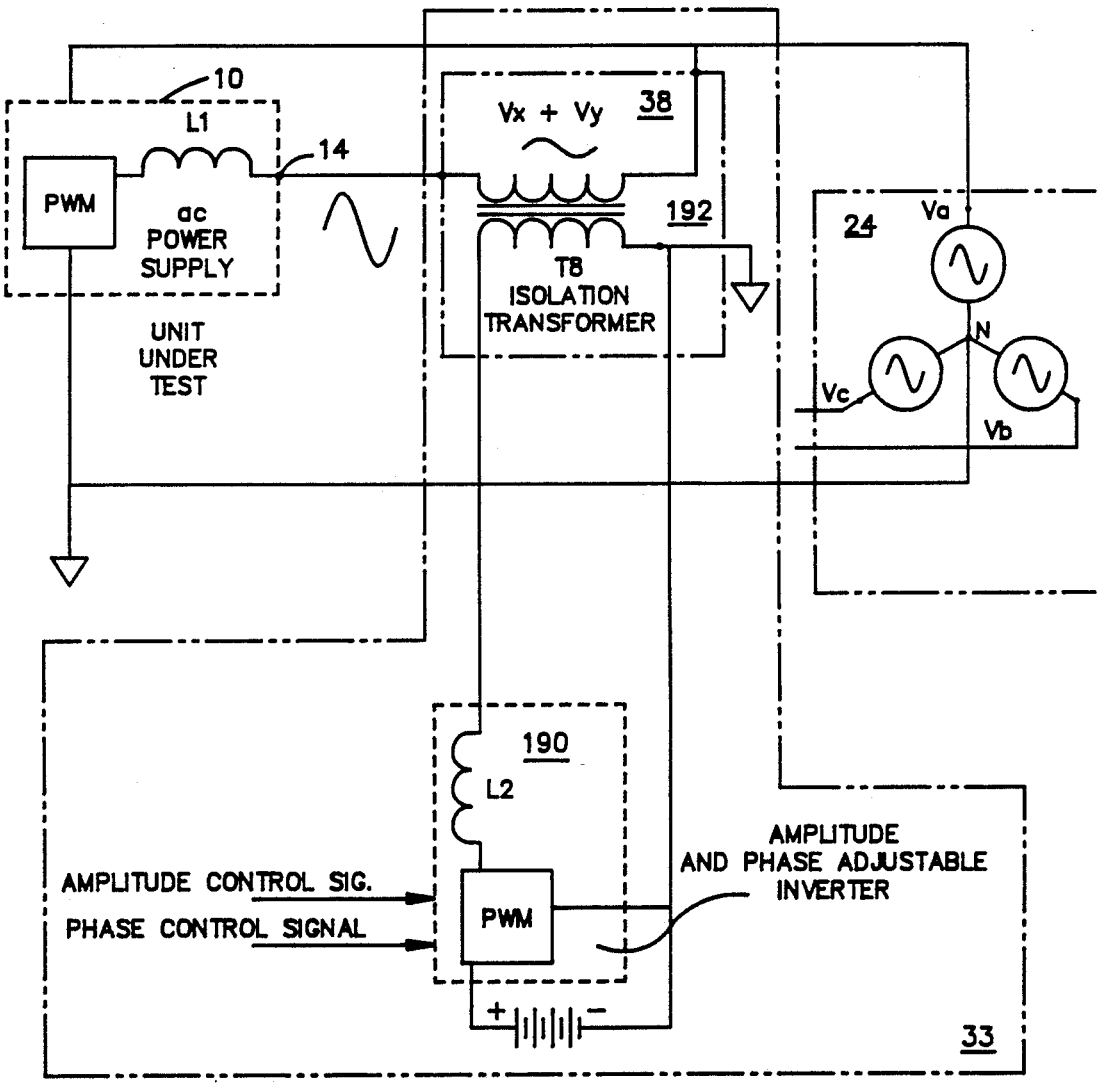
FIG. 9 is a schematic showing a single phase inverter in an ac power supply 10. The power supply input terminals are powered from a single phase source. The power supply sinusoidal output voltage drives the secondary of the recirculating load apparatus output isolation transformer. The primary winding is powered from an amplitude and phase controllable PWM power supply.
Figure 10:
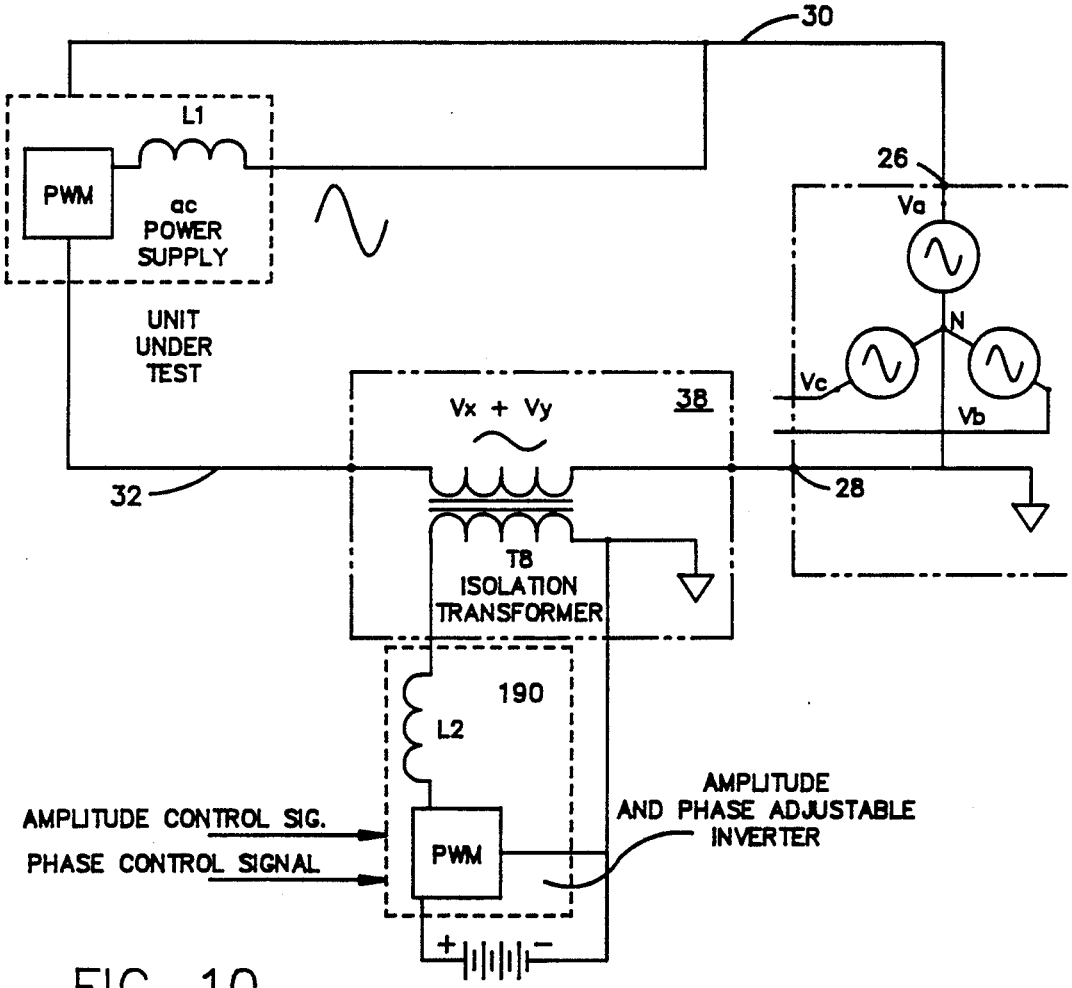
FIG. 10 is a schematic showing a single phase ac power supply. The power supply input terminals are powered from a single phase source. The power supply sinusoidal output voltage return is driven by the secondary of the recirculating load apparatus output isolation transformer. The primary is powered from an amplitude and phase controllable PWM power supply.

FIGS. 9 and 10 shows alternative embodiments of the recirculating load apparatus 33 in which the transformer circuits are replaced by a precision ac power supply 190 driving the equivalent of voltage source 38. Transformer T8, 192 responds to the phase and amplitude controlled signal from precision ac power supply 190 by inserting the sum of the equivalent of voltages Vx and Vy in series with the output of the ac power supply 10 under test. Amplitude and phase control signals are predetermined and provided to the precision ac power supply 190. FIG. 10 differs from the embodiment of FIG. 9 by showing that the voltage source 38 can be positioned in the return line 32 of the burn in circuit.

The servo control features of FIG. 6 are applicable to the embodiments of FIGS. 9 and 10 for controlling the amplitude control signal and the phase control signal into the precision ac power supply 190 with the elimination of the amplifiers 178 and 180, the motors 160 and 162 and the adjustable transformers T5 and T6. The amplitude and phase control signals are coupled to the modified servo system of FIG. 6 in place of the VREF1 and VREF2 signals respectively. The reference error signal from the first integrator 174 and the quadrature error signal from the second integrator 176 would then be used to drive the respective amplitude control signal input, and the phase control signal input to the precision ac supply 190.

Figure 11:
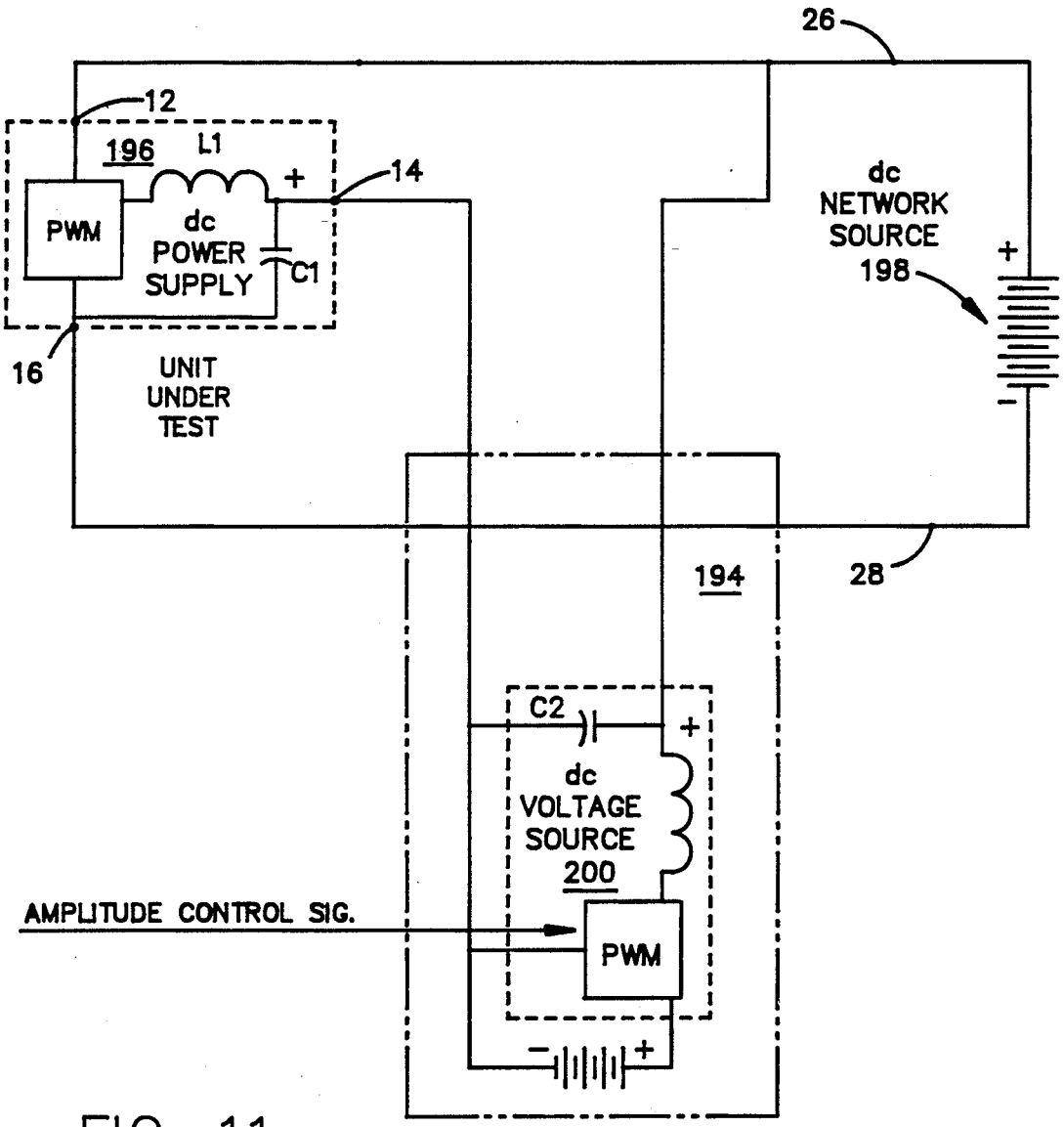
FIG. 11 is a schematic showing a single dc power supply under test. The power supply input terminals are powered from a dc network source. The power supply dc voltage drives an isolated dc voltage source to couple energy back into the dc network source.

FIG. 11 shows an alternative embodiment of the invention circulating load apparatus within phantom block 194 operating in series with a dc power supply 196 and a dc network source 198. The circuit of FIG. 11 can be regarded as a special case of the applications of FIG. 2 in which the frequency of the ac power supply 10, the network source 24 and the voltage source 38 is zero. A dc power supply 196 that is under burn-in test is substituted for the ac power supply 10 in FIG. 2 and a dc network source 198, such as a battery stack is substituted for network source 24. If a low voltage isolated dc voltage source 200 is inserted in place of voltage source 38, the circuit of FIG. 11 is obtained.

The combined voltage of the dc power supply 196 and the dc voltage source 200 must be adjusted to be clamped by the voltage of the dc network source 198. If the output voltage of the dc power supply 196 is only slightly below the voltage of the dc network source 198, the output of the dc power supply 196 can be driven at or near rated load with only a small amount of power being expended by the dc voltage source 194 by adjusting the output voltage of the dc voltage source 200 to obtain the required output current. The voltage of the dc voltage source 200 is increased to raise the sum of the dc power supply 196 output voltage plus the output voltage of the dc voltage source 200 to clamp at the network source voltage. The dc impedance of the dc power supply 196 and the dc voltage source 200 add to limit the output current. If the output voltage of the dc power supply 196 is a small fraction of the dc network source voltage, and if each dc power supply to be tested, has an input voltage section that is isolated from the output voltage section, meaning that the input power is received on two input wires that are separated and isolated from a pair of output lines on which the output voltage is provided, it may be possible to stack the output or secondary sections of a number of dc power supplies in series, their output voltages being added in series to approach the dc network source voltage, before being connected in series with the dc voltage source. In such an arrangement, the inputs would be connected in parallel and the output voltage of the dc network source would be matched to the voltage requirements of the inputs to the dc power supplies.

Newly manufactured dc power supplies are also operated at near rated load for a period of time prior to shipment to increase the field reliability of the units sold by allowing failures to occur prior to shipment. The power dissipated in the output loads is also normally wasted as heat. The output power rating of some +5 Vdc, +12 Vdc power supplies exceeds several hundreds of watts.

However, commercial dc power supplies typically have a primary conversion section that receives ac input power and a secondary conversion section that delivers dc output power. The two sections are typically required to be dc isolated from each other by several megohms of resistance. This feature of commercial dc power supplies permits the output voltage of the secondary conversion sections of separate dc power supplies to be stacked or connected in series to provide a relatively high dc service voltage source. When large numbers of recently manufactured commercial dc power supplies of the same model are burned in, they are operated at the same output load current. The same output load current passes through each of the secondary conversion sections of dc power supplies having their output terminals connected in the series.

Figure 12:
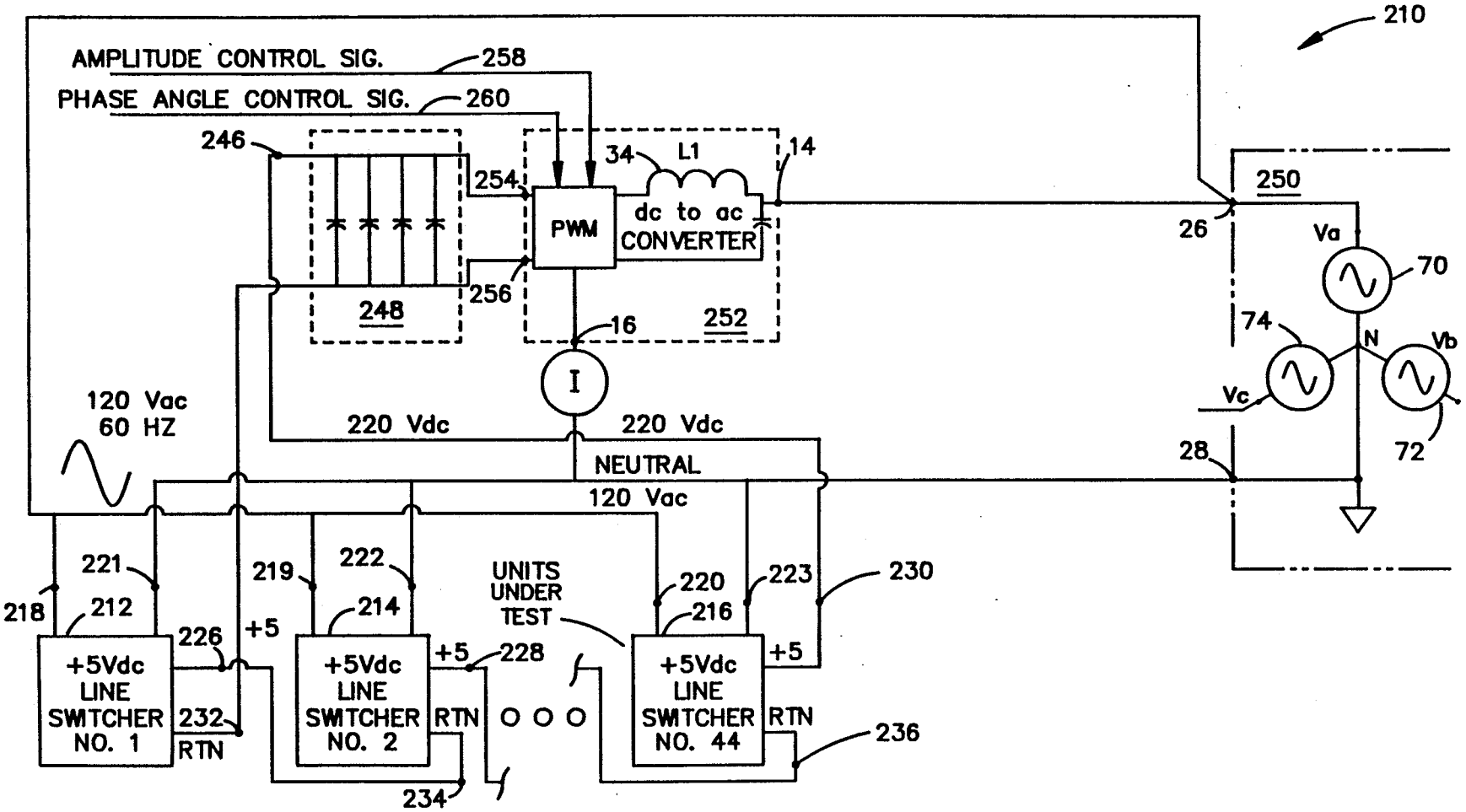
FIG. 12 is a simplified schematic of a recirculating load for a plurality of separate ac to dc power supplies with isolated primary and secondary converter sections using a capacitor and a dc to ac converter with signal lines for the control of output amplitude and output phase angle.

FIG. 12 shows another alternative embodiment of a circulating load apparatus 210 in use with a plurality of conventional commercial dc power supplies 212, 214, 216 that have their outputs connected in series for burn in test, and for the recovery of power normally wasted in dissipative loads. Each of the dc power supplies has an ac power input terminal 218, 219, 220 and an ac power return terminal 221, 222, 223 and each provides a regulated dc output voltage at a dc output voltage terminal 226, 228, 230 with respect to a dc return terminal 232, 234, 236.

The ac power input terminals 218, 219, and 220 are connected to the network source terminal 26, and the ac power return terminals 221, 222 and 223 are connected to the NEUTRAL line, or source return terminal 28. The ac source voltage applied to the ac power input terminals of the primary conversion section of a dc power supply is typically rectified and converted to a filtered dc voltage in the range of 150–170 Vdc or to a 300–340 Vdc level within the dc power supply.

Commercial dc power supplies typically use a known pulse width modulated circuit such as a bridge, half bridge, flyback or forward converter to magnetically transfer energy from the primary conversion section of the dc power supply to the secondary converter section for high frequency rectification, filtering, and regulation prior to delivery at a dc output voltage terminal with respect to a dc isolated return terminal.

The dc power supplies shown in FIG. 12 are typically referred to as LINE SWITCHERS because they are typically powered from an ac voltage source or line service. Each of the three dc power supplies shown, in the series, such as 5 Vdc LINE SWITCHER NO. 1, 212, +5 Vdc LINE SWITCHER NO. 2, 214 and +5 Vdc LINE SWITCHER NO. 44, 216 have a respective primary conversion section and a respective secondary conversion section (not shown). The three separate supplies shown in FIG. 12 represent a group of 44 separate dc power supplies in a burn-in test configuration. The output power provided by the dc power supplies is delivered to the input of a dc to ac converter for conversion to sinusoidal power for insertion back into the ac network source 70.

The outputs of the respective dc power supplies 212, 214 and 216 are connected in series. The +5 Vdc dc output voltage terminal 226 of LINE SWITCHER NO. 1, 212 is shown connected to the dc isolated return terminal 234 of LINE SWITCHER NO. 2, 214. The +5 Vdc dc output voltage terminal 228 of LINE SWITCHER NO. 2, 214 is shown passing to the dc isolated return terminal of a subsequent dc power supply in the series that is not shown. The RTN return terminal 236 of LINE SWITCHER No. 44, 216 is shown passing to the +5 Vdc output voltage terminal of a previous LINE SWITCHER in the series that is not shown.

The +5 Vdc output voltage terminal 230 of LINE SWITCHER NO. 44, 216 is shown connected to a 220 Vdc bus that is connected to a positive terminal 246 of a capacitor 248. The output voltages of the LINE SWITCHERS are combined in series to charge the capacitor 248 to a dc service voltage equal to the sum of the 5 Vdc output voltages of the respective secondary conversion sections of the respective dc power supplies.

Phantom block 250 contains an ac network source 70 providing an ac source voltage at a network source terminal 26 with respect to a neutral terminal 28 described earlier in connection with FIG. 2.

The circuit within phantom block 252 represents a dc to ac converter having input terminals 254, 256 connected to draw power from the capacitor 248 and output terminals 14, 16 connected to the network source terminal and to the source return terminal. The dc to ac converter 252 is a power supply that serves as a means for providing an ac output voltage with a frequency equal the frequency of the ac network source at the network source terminal 26 with respect to the network source return terminal 28.

Circuits for dc to ac converters are known in the art. Commercial dc to ac converters such as the Series 8000 bi-directional converters manufactured by the Deltec Corporation of San Diego, Calif. are suitable, with minor modifications for use as the dc to ac converter of phantom block 252.

Signal lines 258 and 260 represent analog or digital control signal lines or paths for the control of the output amplitude and the phase angle of the output voltage of the dc to ac converter 252. The amplitude control signal might typically be supplied from a variable potentiometer control to vary the duty cycle of a pulse width modulator within the dc to ac converter 252. The phase angle control signal might typically be supplied from a variable potentiometer control to vary the zero crossing time with respect to that of the ac source voltage at network source terminal 26. The control signals on signal lines 258 and 260 represent a means for adjusting the amplitude of the ac output voltage and the phase angle of the ac output voltage with respect to the phase angle of the ac source voltage to control the rate at which power is transferred from the dc service voltage on capacitor 248 to the ac network source 70.

Figure 13:
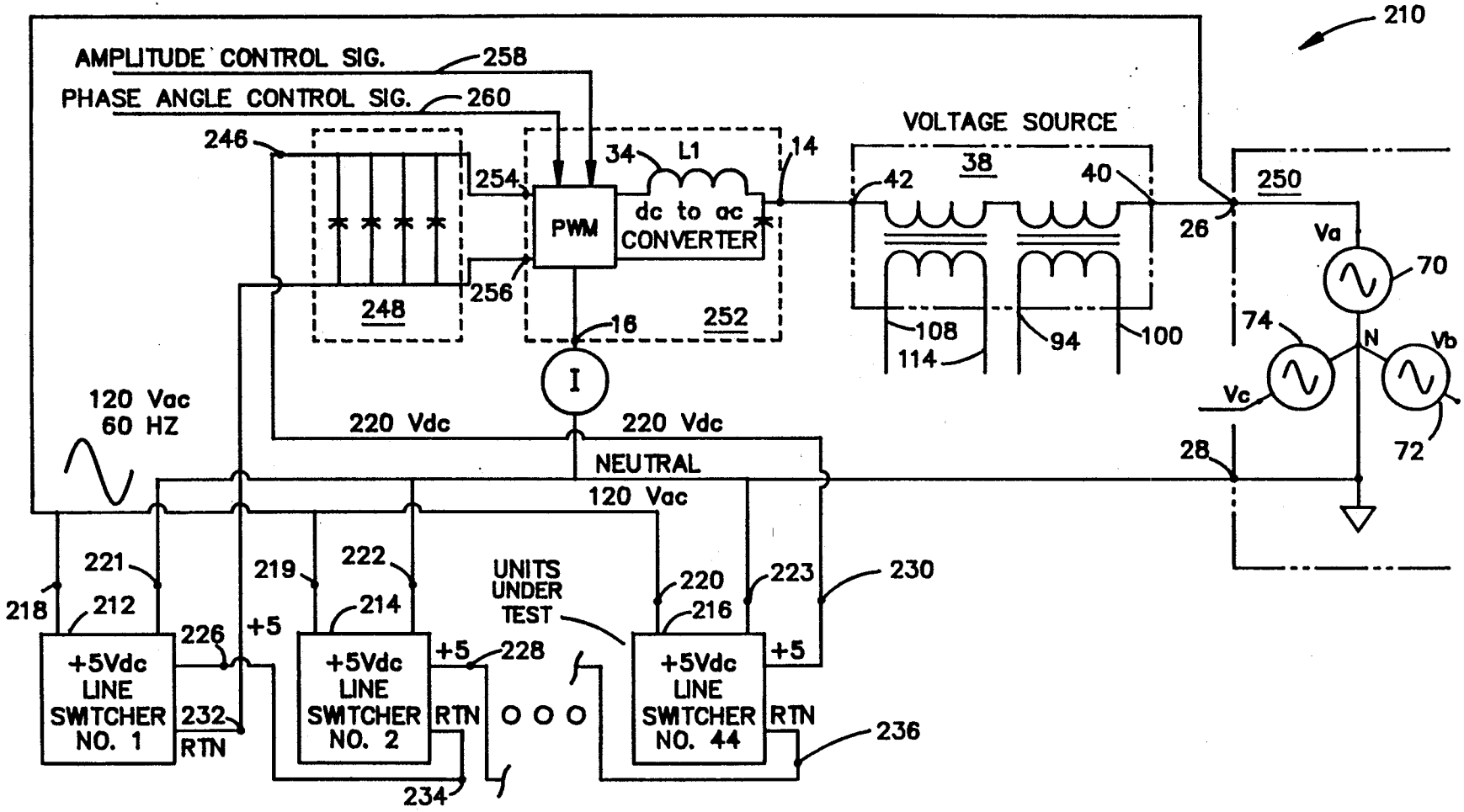
FIG. 13 is a simplified schematic of a recirculating load for a plurality of separate ac to dc power supplies with isolated primary and secondary converter sections using a capacitor and a dc to ac converter and a voltage source for the adjustment and control of output power.

In the alternative embodiment of FIG. 13, a voltage source, such as the circuit within phantom block 38 represents a means for adjusting the amplitude of the ac output voltage and the phase angle of the ac output voltage with respect to the phase angle of the ac source voltage to control the rate at which power is transferred from the dc service voltage on capacitor 248 to the ac network source 70. Voltage source 38 achieves the required control, as described above in connection with the circuits of FIGS. 2, 6, 9 and 10, as it operates in series with the dc to ac converter 252 and the ac network source. The voltage source 38 supplies a voltage between a first terminal, such as a source output terminal 40 and second terminal, such as a source input terminal 42. As shown in FIG. 13, the voltage source 38 is connected in series between the ac network source terminal 26 and the dc to ac converter output terminal 14. The output voltage of dc to ac converter 252 and the voltage source 38 add as the output voltage and phase angle of the voltage source 38 are adjusted to control the delivery of output power to the ac network source 70 from the dc service voltage source at the capacitor positive terminal 246.

An adjusting means, such as the circuit within phantom block 60, as described in connection with FIGS. 2 and 7 is connected to the voltage source 38 to adjust the amplitude and the phase angle of the voltage source 38 with respect to the ac source voltage of the network source to control and keep the output current from the dc to ac converter 252 output terminal 14 to the network source terminal 26 at the value desired for burning in the line switching power supplies under test.

Although the invention has been disclosed and illustrated in detail, it is to be clearly understood that the same is by way of illustration as an example only and is not to be taken by way of limitation. The spirit and scope of this invention is to be limited only by the terms of the appended claims.

What is claimed is:

1. A circulating load apparatus for loading a power supply having a power input terminal, a power output terminal and a power return terminal, the power supply having an internal impedance and operable to provide an output voltage at the power output terminal with respect to the power return terminal, the output voltage of the power supply being controlled to be substantially identical in amplitude to the network voltage of a network source, provided at a network source terminal with respect to a source return terminal, the power return terminal being coupled to the source return terminal, the power supply power input terminal being coupled to the network source terminal to be powered by voltage and current from said network source terminal, the circulating load apparatus comprising:

a voltage source for supplying a voltage between a first and second terminal, the voltage source being connected in series between the network source terminal and the power supply power output terminal; the output voltage of the power supply and the voltage source adding to provide output power to the network source;

adjusting means for adjusting the amplitude of the voltage of the voltage source to position the output current of the power supply within a predetermined range.

2. The circulating load apparatus of claim 1, wherein the voltage source is coupled to be powered by voltage and current from said network source.

3. The circulating load apparatus of claim 2, wherein the adjusting means further comprises a current measuring means for providing an output current signal proportional to the amplitude of the output current from the power supply, and wherein the adjusting means adjusts the voltage of the voltage source to position the output current signal within a predetermined range.

4. A circulating load apparatus for loading a power supply having a power input terminal, a power output terminal and a power return terminal, the power supply having an internal impedance and being characterized to provide an output voltage at the power output terminal with respect to the power return terminal, the output voltage of the power supply being controlled to be substantially identical in amplitude to the network voltage of a network source, provided at a network source terminal with respect to a source return terminal, the power return terminal being coupled to the source return terminal, the power supply power input terminal being coupled to the network source terminal to be powered by voltage and current from said network source terminal, the circulating load apparatus comprising:

a voltage source for supplying a voltage between a first and second terminal, the voltage source being connected in series between the network source terminal and the power supply power output terminal, the voltage source is coupled to be powered by voltage and current from said network source; the output voltage of the power supply and the voltage source adding to provide output power to the network source;

adjusting means for adjusting the amplitude of the voltage of the voltage source to position the output current of the power supply within a predetermined range and wherein the adjusting means further comprises an ammeter connected in series with the power supply and the voltage source external to the network source between the network source terminal and the source return terminal; the voltage of the voltage source being adjustable by an operator to position the output current indicated by the ammeter to be within a predetermined range.

5. The circulating load apparatus of claim 2, wherein the power supply has a sinusoidal output voltage and a sinusoidal input voltage, and wherein, the voltage source is an isolated ac voltage source having a sinusoidal output voltage that is adjusted to obtain the required power supply output current and wherein the network source is a sinusoidal voltage source.

6. A circulating load apparatus for loading a power supply, the power supply having a dc output voltage and a dc input voltage, a power input terminal, a power output terminal and a power return terminal, the power supply having an internal impedance and being characterized to provide an output voltage at the power output terminal with respect to the power return terminal, the output voltage of the power supply being controlled to be substantially identical in amplitude to the network voltage of a network source, provided at a network source terminal with respect to a source return terminal, the power return terminal being coupled to the source return terminal, the power supply power input terminal being coupled to the network source terminal to be powered by voltage and current from said network source terminal, the circulating load apparatus comprising:

a voltage source for supplying a voltage between a first and second terminal, the voltage source being connected in series between the network source terminal and the power supply power output terminal; the output voltage of the power supply and the voltage source adding to provide output power to the network source; and wherein, the voltage source is an isolated dc voltage source coupled to be powered by voltage and current from said network source and having an output voltage that is adjusted to obtain the required output current and wherein the network source is a dc voltage source;

adjusting means for adjusting the amplitude of the voltage of the voltage source to position the output current of the power supply within a predetermined range.

7. A circulating load apparatus for loading a sinusoidal power supply having a power input terminal, a power output terminal and a power return terminal, the power supply having an internal impedance and operable to provide a sinusoidal output voltage at the power output terminal with respect to the power return terminal, the sinusoidal output voltage of the power supply being controlled to be substantially identical in amplitude and frequency to the sinusoidal source voltage from a network source, provided at a network source terminal with respect to a source return terminal, the power return terminal being coupled to the source return terminal, the power supply power input terminal being coupled to the network source terminal to be powered by voltage and current from the network source terminal, the circulating load apparatus comprising:

a voltage source for supplying a sinusoidal amplitude and phase adjustable voltage between a first and second terminal, the frequency of the amplitude and phase adjustable voltage being equal to the frequency of the sinusoidal output voltage of the power supply, the output voltage of the voltage source being connected in series between the network source terminal and the power supply power output terminal; the output voltage of the power supply and the output voltage of the voltage source adding to provide output power to the network source;

adjusting means for adjusting the amplitude and phase of the amplitude and phase adjustable sinusoidal voltage of the voltage source to position the output current of the power supply within a predetermined range.

8. The circulating load apparatus of claim 7, wherein the voltage source is coupled to be powered by voltage and current from the network source.

9. A circulating load apparatus for loading a sinusoidal power supply having a power input terminal a power output terminal and a power return terminal, the power supply having an internal impedance and being characterized to provide a sinusoidal output voltage at the power output terminal with respect to the power return terminal, the sinusoidal output voltage of the power supply being controlled to be substantially identical in amplitude and frequency to the sinusoidal source voltage from a network source provided at a network source terminal with respect to a source return terminal, and wherein the network source further comprises:

a first, second and third voltage source for providing a first, second and third source voltages with respect to the source return terminal, the second source voltage trailing the first source voltage by substantially 120 degrees and the third source voltage trailing the second source voltage by substantially 120 degrees, each respective source voltage being substantially equal in amplitude, the power return terminal being coupled to the source return terminal the power supply power input terminal being coupled to the network source terminal to be powered by voltage and current from the network source terminal, the circulating load apparatus comprising:

a voltage source for supplying a sinusoidal amplitude and phase adjustable voltage between a first and second terminal, the frequency of the amplitude and phase adjustable voltage being equal to the frequency of the sinusoidal output voltage of the power supply, the output voltage of the voltage source being connected in series between the network source terminal and the power supply power output terminal; the output voltage of the power supply and the output voltage of the voltage source adding to provide output power to the network source;

adjusting means for adjusting the amplitude and phase of the amplitude and phase adjustable sinusoidal voltage of the voltage source to position the output current of the power supply within a predetermined range; the adjusting means further comprising:

a first adjustable transformer driven by the first source voltage with respect to the source return terminal for providing an adjustable reference voltage, and a second adjustable transformer driven by the second source voltage with respect to the third source voltage for providing an adjustable quadrature voltage, and wherein, the voltage source is coupled to be powered by said adjustable reference voltage and the adjustable quadrature voltage.

10. The circulating load apparatus of claim 9, wherein the voltage source further comprises a reference isolation transformer and a quadrature isolation transformer, each isolation transformer having a respective primary and second winding, the reference isolation transformer primary winding being driven by the adjustable reference voltage, the quadrature isolation transformer primary winding being driven by the adjustable quadrature voltage, the reference isolation transformer secondary and the quadrature isolation transformer secondary being connected in series with the power supply between the network source and the power supply, the adjustable reference voltage and the adjustable quadrature voltage being adjusted to provide an adjusted secondary reference voltage across the reference isolation transformer secondary and an adjusted secondary quadrature voltage across the quadrature isolation transformer secondary, the amplitudes of the adjusted secondary reference voltage and the adjusted secondary quadrature voltage being sufficient to provide output power from the power supply to the network source.

11. The circulating load apparatus of claim 9, wherein the voltage source further comprises an isolation transformer having a first primary winding driven by the adjustable reference voltage, a second primary winding driven by the adjustable quadrature voltage, and a secondary winding connected in series with the power supply between the network source and the power supply, the adjustable reference voltage and the adjustable quadrature voltage being adjusted to provide the sum of an adjusted secondary reference voltage and an adjusted secondary quadrature voltage across the isolation transformer secondary, the amplitudes of the adjusted secondary reference voltage and the adjusted secondary quadrature voltage being sufficient to provide output power from the power supply to the network source.

12. The circulating load apparatus of claim 9, wherein the first and second adjustable transformers are driven by respective first and second motors, each motor being responsive to a servo motor signal for adjusting the output voltage of the respective adjustable transformer, and wherein the adjusting means further comprises:

current sensing means for sensing the amplitude of current passing through the power supply and for providing a current amplitude signal proportional to the current amplitude;

servo means responsive to the current amplitude signal and to a predetermined first and second reference signal for providing a first motor signal to drive the first motor to adjust the adjustable reference voltage to adjust the in-phase component of power supply current to match the first reference signal and for providing a second motor signal to drive the second motor to adjust the adjustable quadrature voltage to adjust the quadrature component of power supply current to match the second reference signal.

13. The circulating load apparatus of claim 9, wherein the adjusting means further comprises:

a network source reference isolation transformer and a network source quadrature isolation transformer, each network source isolation transformer having a respective primary and secondary winding, the network source reference isolation transformer primary winding being driven by the first source voltage with respect to the source return terminal, the network source quadrature isolation transformer primary winding being driven by the second source voltage with respect to the third source voltage, and wherein the network source reference isolation transformer secondary is coupled to drive the first adjustable transformer for providing the adjustable reference voltage, and the network source quadrature isolation transformer secondary is coupled to drive the second adjustable transformer for providing the adjustable quadrature voltage; and wherein, the voltage source further comprises an isolation transformer having, a first primary winding driven by the adjustable reference voltage, a second primary winding driven by the adjustable quadrature voltage, and a second winding connected in series with the power supply between the network source and the power supply, the adjustable reference voltage and the adjustable quadrature voltage being adjusted to provide the sum of an adjusted secondary reference voltage and an adjusted secondary quadrature voltage across the isolation transformer secondary, the amplitudes of the adjusted secondary reference voltage and the adjusted secondary quadrature voltage being sufficient to provide output power from the power supply to the network source.

14. The circulating load apparatus of claim 10, wherein the adjusting means further comprises:

a network source reference isolation transformer and a network source quadrature isolation transformer, each network source isolation transformer having a respective primary and secondary winding, the network source reference isolation transformer primary winding being driven by the first source voltages with respect to the source return terminal, the network source quadrature isolation transformer primary winding being driven by the second source voltage with respect to the third source voltage, and wherein the network source reference isolation transformer secondary is coupled to drive the first adjustable transformer for providing the adjustable reference voltage, and the network source quadrature isolation transformer secondary is coupled to drive the second adjustable transformer for providing the adjustable quadrature voltage; and wherein, the reference isolation transformer primary winding being driven by the adjustable reference voltage, and the quadrature isolation transformer primary winding being driven by the adjustable quadrature voltage.

15. A circulating load apparatus for loading a sinusoidal power supply having a power input terminal, a power output terminal and a power return terminal, the power supply having an internal impedance and operable to provide a sinusoidal output voltage at the power output terminal with respect to the power return terminal, the sinusoidal output voltage of the power supply being controlled to be substantially identical in amplitude and frequency to a sinusoidal source voltage from a network source, provided at a network source terminal with respect to a source return terminal, the network source having a first, second and third voltage source for providing a first, second and third source voltages with respect to the source return terminal, the second source voltage trailing the first source voltage by substantially 120 degrees and the third source voltage trailing the second source voltage by substantially 120 degrees, each respective source voltage being substantially equal in amplitude, the power return terminal being coupled to the source return terminal, the power input terminal being coupled to the network source terminal to be powered by voltage and current from the network source, the circulating load apparatus comprising:

a first adjustable transformer driven by the first source voltage with respect to the source return terminal for providing an adjustable reference voltage, and a second adjustable transformer driven by the second source voltage with respect to the third source voltage for providing an adjustable quadrature voltage, an isolation transformer having a first primary winding driven by the adjustable reference voltage, a second primary winding driven by the adjustable quadrature voltage, and a secondary winding connected with the power supply and network source, the adjustable reference voltage and the adjustable quadrature voltage being adjusted to provide a scaled sum voltage across the isolation transformer secondary, the amplitudes of the adjustable reference voltage and the adjustable quadrature voltage being adjusted to adjust the scaled sum voltage to provide output power from the power supply to the network source.

16. A circulating load apparatus comprising:

an ac network source providing an ac source voltage at a network source terminal with respect to a neutral terminal;

a plurality of dc power supplies each dc power supply having a primary conversion section with an ac power input terminal and an ac power return terminal, and an isolated secondary conversion section providing a dc output voltage at a dc output voltage terminal with respect to a dc return terminal, each ac power input terminal being connected to the network source terminal and each ac power return terminal being connected to the neutral terminal, the secondary conversion sections of each respective dc power supply being connected in series to charge a capacitor to a dc service voltage;

a dc to ac converter means having input terminals connected to be powered from the dc service voltage on the capacitor and a power output terminal coupled to the network source terminal and a power return terminal coupled to the source return terminal, the dc to ac converter being adjusted to deliver ac power to the ac network source.

17. The circulating load apparatus of claim 16, wherein the dc to ac converter means further comprises;

a means for adjusting the amplitude of the ac output voltage and the phase angle of the ac output voltage with respect to the phase angle of the ac source voltage to control the rate at which power is transferred from the capacitor to the ac network source.

18. The circulating load apparatus of claim 17, wherein the means for adjusting the amplitude of the ac output voltage and the phase angle of the ac output voltage with respect to the phase angle of the ac source voltage to control the rate at which power is transferred from the dc service voltage source on the capacitor to the ac network source further comprises:

a voltage source for supplying a voltage between a power input terminal and a power output terminal, the voltage source being connected in series with the ac network source and the dc to ac converter means output terminal; the output voltage of the dc to ac converter and the voltage source adding to provide output power to the network source; and adjusting means for adjusting the amplitude of the voltage of the voltage source to position the output current of the power supply within a predetermined range.

19. The circulating load apparatus of claim 18, wherein the voltage source is coupled to be powered by voltage and current from said network source.

20. The circulating load apparatus of claim 19, wherein the adjusting means further comprises a current measuring means for providing an output current signal proportional to the amplitude of the output current from the dc to ac converter means, and wherein the adjusting means responds to the output current signal by adjusting the voltage of the voltage source to position the output current signal within a predetermined range.

21. The circulating load apparatus of claim 19, wherein the adjusting means further comprises an ammeter connected in series with the ac to dc converter means and the voltage source external to the network source between the network source terminal and the source return terminal; the voltage of the voltage source being adjusted by an operator to position the output current indicated by the ammeter to be within a predetermined range.

22. A circulating load power saving process comprising the steps of:

connecting an ac network source to provide an ac source voltage to the ac power input terminals of a plurality of ac to dc power supplies, each dc power supply having a primary conversion section that is dc isolated from a secondary conversion section, each secondary conversion section having a dc output voltage terminal and a dc return terminal;

connecting the output terminals of separate secondary conversion sections of each respective ac to dc power supply in series to charge a capacitor to a dc service voltage equal to the sum of dc output voltages of the respective secondary conversion sections;

connecting the input power terminals of a dc to ac converter to the dc service voltage to provide an ac output voltage having a frequency equal the frequency of the ac network source; and operating the ac to dc power supplies and the dc to ac converter to deliver a controlled level of ac power to the network source.

* * * * *